US008133139B2

(12) United States Patent
Avis et al.

(10) Patent No.: US 8,133,139 B2
(45) Date of Patent: Mar. 13, 2012

(54) PANEL CONFIGURATION FOR A GAME BALL

(75) Inventors: Richard Avis, Tigard, OR (US); Chris S. Page, Portland, OR (US); Geoffrey C. Raynak, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 12/956,593

(22) Filed: Nov. 30, 2010

(65) Prior Publication Data

US 2011/0070982 A1 Mar. 24, 2011

Related U.S. Application Data

(63) Continuation of application No. 11/524,088, filed on Sep. 20, 2006, now Pat. No. 7,862,458.

(51) Int. Cl.
*A63B 41/08* (2006.01)

(52) U.S. Cl. ..... 473/604; 473/607

(58) Field of Classification Search ..... 473/594, 473/595, 598, 599, 603–605, 607; D21/707, D21/713

See application file for complete search history.

(56) References Cited

U.S. PATENT DOCUMENTS

| | | | | |
|---|---|---|---|---|
| D45,734 | S | 5/1914 | Worthington | |
| 4,830,373 | A | 5/1989 | Dehnert et al. | |
| 5,709,623 | A | 1/1998 | Schwaner | |
| 5,820,501 | A | 10/1998 | Soofi | |
| D422,040 | S | 3/2000 | Stalberger, Jr. | |
| 6,117,504 | A | 9/2000 | Yoshikawa | |
| 6,988,969 | B2 * | 1/2006 | Avis | 473/599 |
| 7,862,458 | B2 * | 1/2011 | Avis et al. | 473/604 |
| 2003/0203779 | A1 | 10/2003 | Avis | |
| 2007/0004542 | A1 * | 1/2007 | Park | 473/604 |
| 2007/0225094 | A1 | 9/2007 | Nix | |

FOREIGN PATENT DOCUMENTS

| | | | |
|---|---|---|---|
| DE | 3726830 | C1 | 12/1988 |
| DE | 19629727 | A1 | 1/1998 |
| DE | 19904771 | A1 | 8/2000 |
| DE | 19905044 | A1 | 8/2000 |
| DE | 19905046 | A1 | 8/2000 |
| DE | 202004011143 | U1 | 12/2005 |
| KR | 10-2005-076098 | A | 7/2005 |
| NL | 1014429 | C6 | 8/2001 |

OTHER PUBLICATIONS

International Search Report for International Application No. PCT/US2007/019883, mailed Feb. 21, 2008.

International Preliminary Report on Patentability mailed Apr. 2, 2009, International Application No. PCT/US2007/019883, 13 pages.

* cited by examiner

*Primary Examiner* — Steven Wong

(74) *Attorney, Agent, or Firm* — Banner & Witcoff, Ltd

(57) ABSTRACT

A game ball, which may be a soccer ball or a variety of other types of ball. The game ball includes a plurality of pentagonal panels, with each of the pentagonal panels having five convex edges. The game ball also includes a plurality of hexagonal panels, with each of the hexagonal panels having three substantially linear edges and three concave edges. The pentagonal panels and the hexagonal panels are connected along abutting concave edges and convex edges, and the hexagonal panels are connected each other along abutting linear edges.

17 Claims, 10 Drawing Sheets

PANEL CONFIGURATION FOR A GAME BALL

CROSS REFERENCE TO RELATED APPLICATIONS

This application is a continuation of U.S. application Ser. No. 11/524,088 filed on Sep. 20, 2006, entitled "Panel Configuration for a Game Ball," herein incorporated by reference in its entirety.

BACKGROUND

A soccer ball, also referred to as a football, is the primary article of equipment used in the game of soccer. The traditional soccer ball conventionally includes a paneled casing that surrounds an inflatable bladder. The casing is formed of a plurality of durable, wear-resistant panels that are stitched together along abutting edges to form a closed surface. The bladder is located on the interior of the casing and formed of a material that is substantially impermeable to air. The bladder also includes a valved opening, accessible through the casing, to facilitate inflation. When inflated, the bladder expands and places an outward pressure upon the casing, thereby inducing the casing to take a substantially spherical shape, but not necessarily a perfectly spherical shape. Some soccer balls may also include a lining, which may include foam or a textile, between the bladder and the casing.

In mathematical terms, the panels that form the casing of the traditional soccer ball correspond to the various faces of a regular, truncated icosahedron. An icosahedron is a polyhedron having twenty faces. The term regular, when applied to an icosahedron, denotes a configuration wherein each of the twenty faces is an equally-dimensioned, equilateral triangle. A regular icosahedron, therefore, includes twenty equilateral triangular faces and twelve vertices that are formed where points of five triangular faces meet. A regular, truncated icosahedron is a regular icosahedron, as described, wherein each of the twelve vertices are removed (i.e., truncated) to form a pentagonal face. The remaining portions of the original twenty faces become equilateral hexagons. Accordingly, a regular, truncated icosahedron is a polyhedron having thirty-two faces, twelve of which are equilateral pentagons and twenty of which are equilateral hexagons, and sixty vertices formed where the points of three faces meet.

The traditional soccer ball casing is modeled on the regular, truncated icosahedron and includes thirty-two panels: twenty equilateral hexagonal panels and twelve equilateral pentagonal panels. The panels are stitched together along abutting edges. The internal pressure imparted by the bladder causes each panel of the traditional soccer ball to bow outward, thereby inducing a substantially, but not perfectly, spherical shape in the soccer ball. When the bladder is inflated, the area of contact between the bladder and casing is greater for the hexagonal panels than the pentagonal panels. This difference leads to the hexagonal panels bearing more stress from the bladder and may result in non-uniform deformation characteristics for the casing. Whether the ball is struck on a hexagonal panel or a pentagonal panel can, therefore, affect the subsequent path and velocity of the soccer ball. The difference in stress described above may also result in uneven wear between the hexagonal panels and the pentagonal panels. Also, the seams between the hexagonal panels may bear greater stress than the seams between hexagonal and pentagonal panels.

SUMMARY

Various examples of the invention involve a substantially spherical game ball that includes a plurality of pentagonal panels and a plurality of hexagonal panels. The pentagonal panels have first edges, and at least one of the first edges has a non-linear configuration. The hexagonal panels have second edges, and at least one of the second edges has a non-linear configuration. The pentagonal panels and the hexagonal panels are connected along abutting first edges and second edges, and the hexagonal panels are connected to each other along abutting second edges.

The first edges having the non-linear configuration may be convex, and the second edges having the non-linear configuration may be concave, with the abutting second edges being substantially linear. As an alternative, the first edges having the non-linear configuration may be concave, and the second edges having the non-linear configuration may be convex, with the abutting second edges are substantially linear. In some configurations, the game ball may include at least one decagonal panel having a shape of two of the hexagonal panels.

In further configurations, three of the second edges of each of the hexagonal panels may have the non-linear configuration, and three of the second edges of each of the hexagonal panels may be substantially linear. A length of a chord of each of the second edges with the non-linear configuration may be greater than a length of the second edges that are substantially linear. For example, the length of the chord may be in a range of 1.10 and 1.30 times a length of the second edges that are substantially linear, or the length of the chord may be approximately 1.19 times a length of the second edges that are substantially linear.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose various game balls in accordance with various examples of the invention. The game balls are depicted as having an exterior panel configuration that is suitable for soccer balls. Concepts associated with the exterior panel configuration may also be applied to other types of game balls, including volleyballs, baseballs, and softballs, for example. Accordingly, the concepts discussed herein may be applied to a wide range of game ball types.

Figure 1:
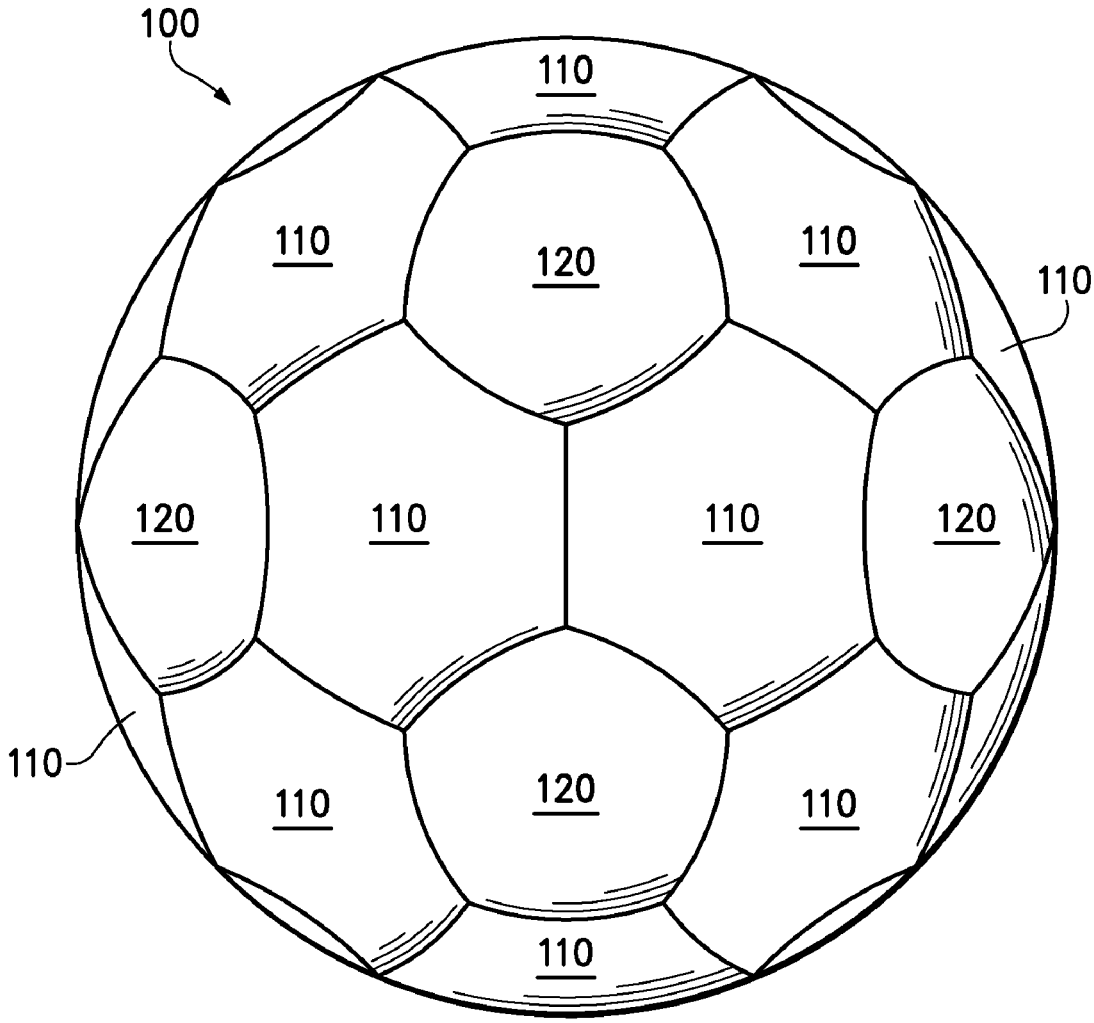
FIG. 1 is an elevation view of a game ball in accordance with the present invention.

With reference to FIG. 1, a game ball 100 is depicted as having an outer casing that includes twenty hexagonal panels 110 and twelve pentagonal panels 120. Panels 110 and 120 are joined together along abutting edges and form substantially all of an outer surface of ball 100. Although hexagonal panels 110 may each have the configuration of an equilateral hexagon, the term "hexagonal" is utilized herein to denote that hexagonal panels 110 exhibit a generally six-sided structure. Similarly, although pentagonal panels 120 may each have the configuration of an equilateral pentagon, the term "pentagonal" is utilized herein to denote that pentagonal panels 120 exhibit a generally five-sided structure. As discussed in greater detail below, panels 110 and 120 may have straight edges, curved edges (i.e., concave or convex), combinations of straight and curved edges, and edges of different lengths. In general, however, hexagonal panels 110 will have a generally six-sided structure and pentagonal panels 120 will have a generally five-sided structure.

Figure 2:
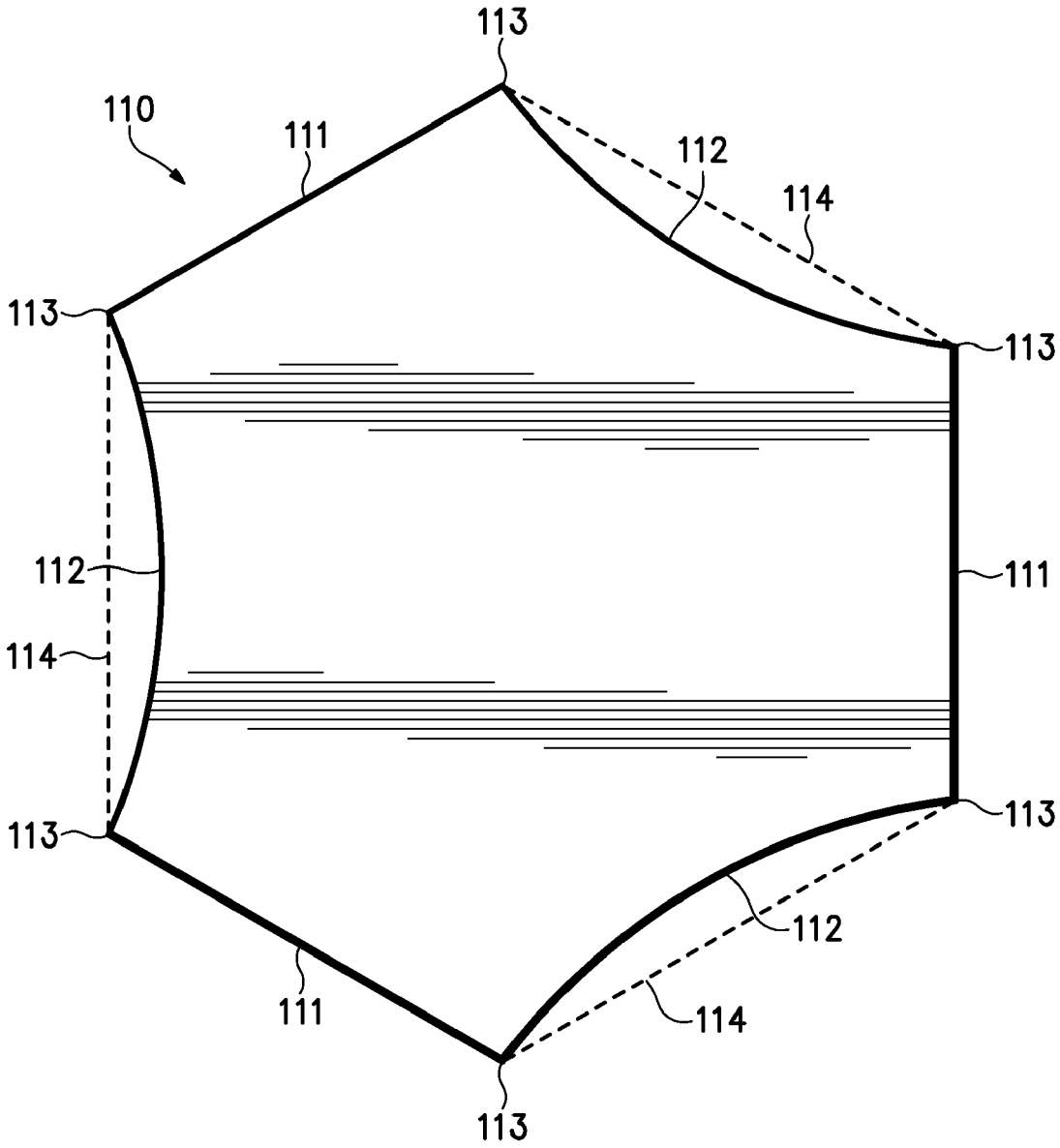
FIG. 2 is a plan view of a hexagonal panel of the game ball.

An individual hexagonal panel 110 is depicted in FIG. 2 as having three edges 111 that alternate with three edges 112. Each hexagonal panel 110 also includes six vertices 113 located at an intersection (i.e., vertex) of adjacent edges 111 and 112. Whereas each of edges 111 have a substantially straight configuration, each of edges 112 are curved or arced inward to impart a concave configuration. The inward curve of edges 112 is depicted as being an arc (i.e., a section of a circle), but may also be formed to have other curved shapes. In some configurations, the inward curve may incorporate straight sections or other non-regular configurations. Accordingly, the configuration of the inward curve of edges 112 may vary significantly.

A plurality of chords 114 are shown, for purposes of reference, as dashed lines between vertices 113 that bound each of edges 112. Although edges 111 may have a length that is identical to a length of chords 114, edges 111 are depicted as being shorter than chords 114. More particularly, each chord 114 is depicted as having a length that is approximately 1.19 times the length of each edge 111. In some configurations, the relative difference between the lengths of edges 111 and chords 114 may vary. For example, the length of each chord 114 may be in a range of 1.10 and 1.30 times the length of each edge 111, or the length of each chord 114 may be in a range of 1.01 and 1.50 times the length of each edge 111. In some configurations, the length of each edge 111 may even be greater than or equal to the length of each chord 114. Accordingly, the relative lengths of edges 111 and chords 114 may vary significantly.

The relative lengths of edges 112 and chords 114 may also vary. Each edge 112 is depicted as having a length of that is approximately 1.026 times the length of each chord 114. In some configurations, the relative difference between the lengths of edges 112 and chords 114 may vary. For example, the length of each edge 112 may be in a range of 1.001 and 1.50 times the length of each chord 114. Accordingly, the relative lengths of edges 112 and chords 114 may vary significantly.

The dimensions of hexagonal panels 110 may vary depending upon the desired size of ball 100. More particularly, as ball 100 increases in size, the dimensions of hexagonal panels 110 may increase proportionally. As an example, however, edges 111 may have a length of 39.0 millimeters, chords 114 may have a length of 46.3 millimeters, and the radius of curvature in edges 112 may be 60.5 millimeters.

Figure 3:
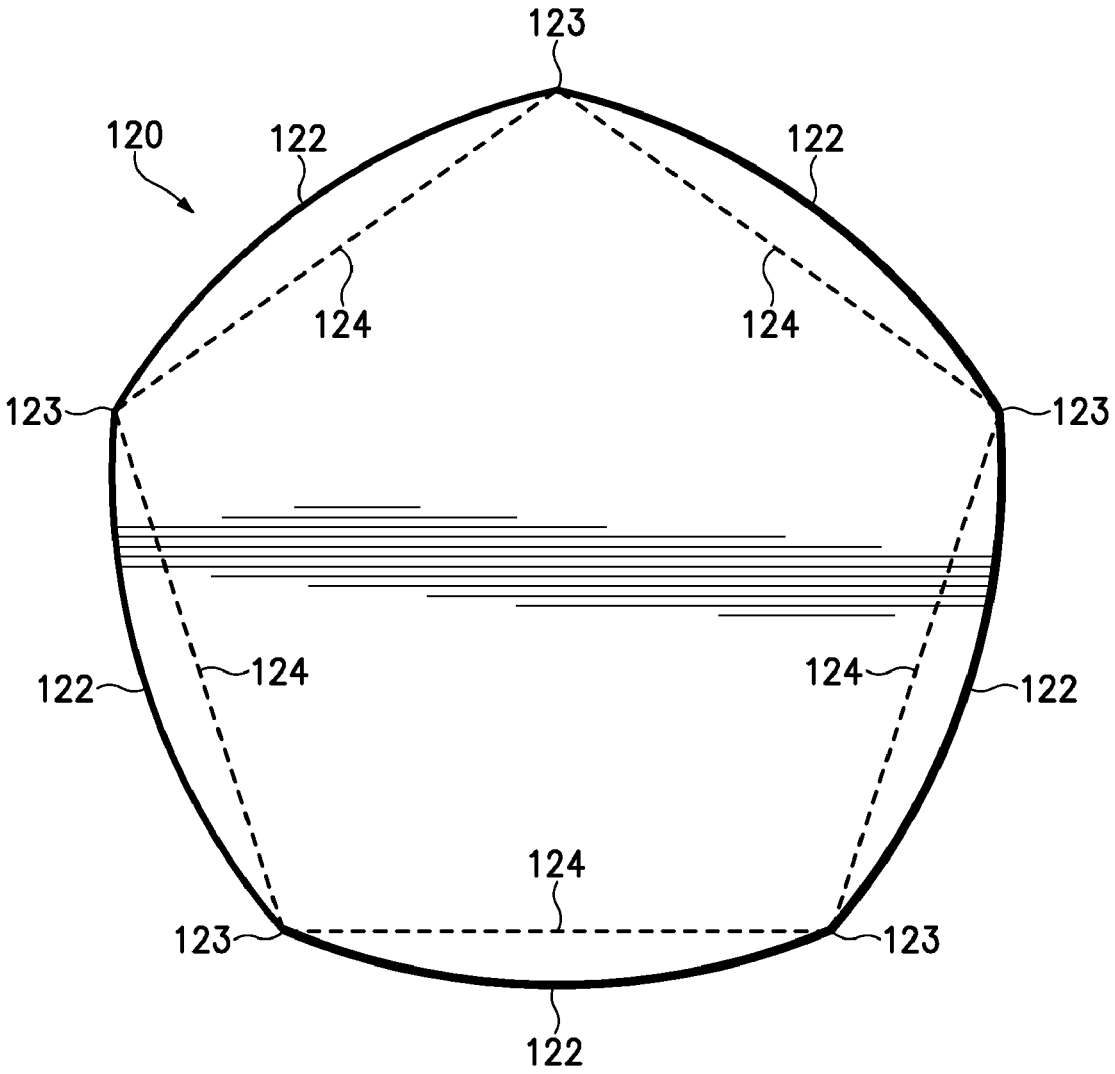
FIG. 3 is a plan view of a pentagonal panel of the game ball.

An individual pentagonal panel 120 is depicted in FIG. 3 as having five edges 122 and six vertices 123 located at an intersection (i.e., vertex) of adjacent edges 122. Each of edges 122 are curved or arced outward to impart a convex configuration. The outward curve of edges 122 is depicted as being an arc (i.e., a section of a circle), but may also be formed to have other curved shapes. In some configurations, the outward curve may incorporate straight sections or other non-regular configurations. Accordingly, the configuration of the outward curve of edges 122 may vary significantly. In general, however, the outward curve of edges 122 will have a shape that is complementary to the shape of in the inward curve of edges 112, thereby facilitating the mating and joining of edges 112 and 122, as described in greater detail below.

A plurality of chords 124 are shown, for purposes of reference, as dashed lines between vertices 123 that bound each of edges 122. In general, the length of chords 124 is substantially equal in length to chords 114. Whereas chords 114 are located on the exterior of hexagonal panels 110, chords 124 extend through the interior portions of panels 120.

The dimensions of pentagonal panels 120 may vary depending upon the desired size of ball 100. More particularly, as ball 100 increases in size, the dimensions of pentagonal panels 120 may increase proportionally. As an example, however, chords 124 may have a length of 46.3 millimeters, and the radius of curvature in edges 122 may be 60.5 millimeters.

Figure 4:
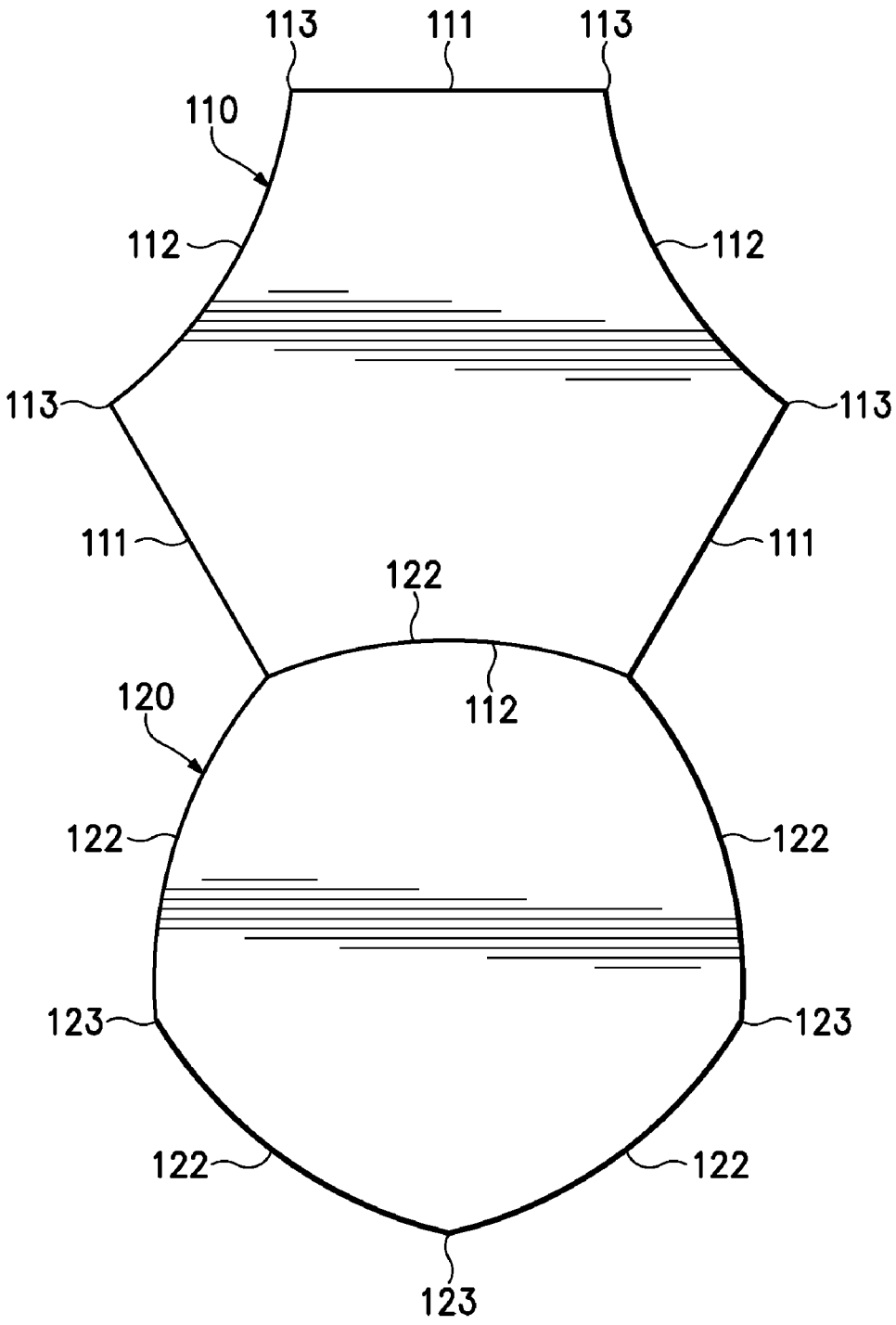
FIG. 4 is a plan view of the hexagonal panel and pentagonal panel joined along abutting edges.

The manner in which panels 110 and 120 are joined to form a seam between panels 110 and 120 is depicted in FIG. 4. In general, panels 110 and 120 are arranged such that edges 122 extend into the concave area formed by edges 112 and abut edges 112. Stitching, adhesives, or bonding operations, for example, are then utilized to join edges 112 and 122 to form a seam. In some configurations of ball 100, each of panels 110 and 120 may include additional material that extends around each of panels 110 and 120 to form flanges that are sewn together. For example, each of panels 110 and 120 may include an additional five millimeters of material that forms the flanges, and the flange material of each panel 110 and 120 may be turned toward an interior of ball 10 and sewn. Accordingly, a variety of techniques may be utilized to join panels 110 and 120.

The manner in which panels 110 are joined to each other is similar. In general, two panels 110 are arranged such that edges 111 abut each other. Stitching, adhesives, or bonding operations, for example, are then utilized to join edges 111. As with the joining of panels 110 and 120, flanges (i.e., additional material) may also be utilized to facilitate joining.

Although not depicted, ball 100 may also include any or all of a foam layer, a latex layer, a textile layer, and a bladder within the casing formed by panels 110 and 120. The foam layer may be located adjacent to an interior surface of the casing to enhance the overall pliability and cushioning of ball 100. The thickness of the foam layer may range from 0.5 millimeters to 4.5 millimeters, for example, and suitable materials include a variety of polymer foams, such as polyolefin foam. The latex layer may be located adjacent the foam layer and opposite panels 110 and 120 to provide enhanced energy return. The textile layer is positioned adjacent the latex layer and may be formed of natural cotton textiles, polyester textiles, or textiles that incorporate both cotton and polyester fibers. The bladder is the inner-most layer of ball 100 and is formed of a material that is substantially impermeable to air, including natural rubber, butyl rubber, or polyurethane. The bladder may also include a valved opening (not depicted) that extends through the textile layer, latex layer, foam layer, and casing to facilitate the introduction of pressurized air. When inflated the proper pressure, the bladder expands, thereby inducing ball 100 to take a substantially spherical shape.

Based upon the above discussion, ball 100 includes twenty hexagonal panels 110 and twelve pentagonal panels 120. Whereas edges 112 of hexagonal panels 110 curve inward or otherwise have a concave configuration, edges 122 of pentagonal panels 120 curve outward or otherwise have a convex configuration. An advantage of this configuration relates to the overall sphericity of ball 100. In comparison with the hexagonal panels of the traditional soccer ball, hexagonal panels 110 have lesser area due to the concavity in edges 112. Similarly, in comparison with the pentagonal panels of the traditional soccer ball pentagonal panels 120 have greater area due to the convexity in edges 122. As discussed in the Background section above, the area of contact between the bladder and casing of the traditional soccer ball is greater for the hexagonal panels than the pentagonal panels. This difference leads to the hexagonal panels of the traditional soccer ball bearing more stress from the bladder and may result in non-uniform deformation characteristics for the casing. In ball 100, however, the area of contact is more equal because of the reduced area of hexagonal panels 110 and the increased area of pentagonal panels 120. That is, hexagonal panels 110 and pentagonal panels 120 experience more equal stresses, which induces ball 100 to take a more spherical shape. In addition, this configuration has the potential to substantially equalize the stiffness associated with each of hexagonal panels 110 and pentagonal panels 120.

The more equal stresses in hexagonal panels 110 and pentagonal panels 120 also serves to equalize the stresses experienced by seams between panels 110 and 120. As discussed in the Background section above, the seams between the hexagonal panels of the traditional soccer ball may bear greater stress than the seams between hexagonal and pentagonal panels. By equalizing the stresses in panels 110 and 120, the stresses at the seams between panels 110 and 120 are more equal, thereby reducing the probability of failure in the seams. Similarly, the more uniform stress may also result in more even wear between hexagonal panels 110 and pentagonal panels 120.

Another advantage of ball 100 relates to the deflection of panels 110 and 120. More particularly, the more equal stresses and stiffness causes the deflection of panels 110 to be substantially equal to the deflection of panels 120 upon the application of a force to the exterior of ball 100. That is, a force applied to the center of one of panels 110 will cause a deflection that is substantially equal to the deflection caused by an indentical force applied to a center of one of panels 120. By providing ball 100 with the shapes for panels 110 and 120 discussed above, the stresses and stiffnesses induced in hexagonal panels 110 and pentagonal panels 120 are substantially equal, thereby resulting in more uniform deformation characteristics for the casing. Whether the ball is struck on one of hexagonal panels 110 or one of pentagonal panels 120, the more uniform deformation (which is caused by more uniform stresses and stiffness) may cause the subsequent path and velocity of ball 100 to be similar regardless of where ball 100 is struck.

Figure 5A:
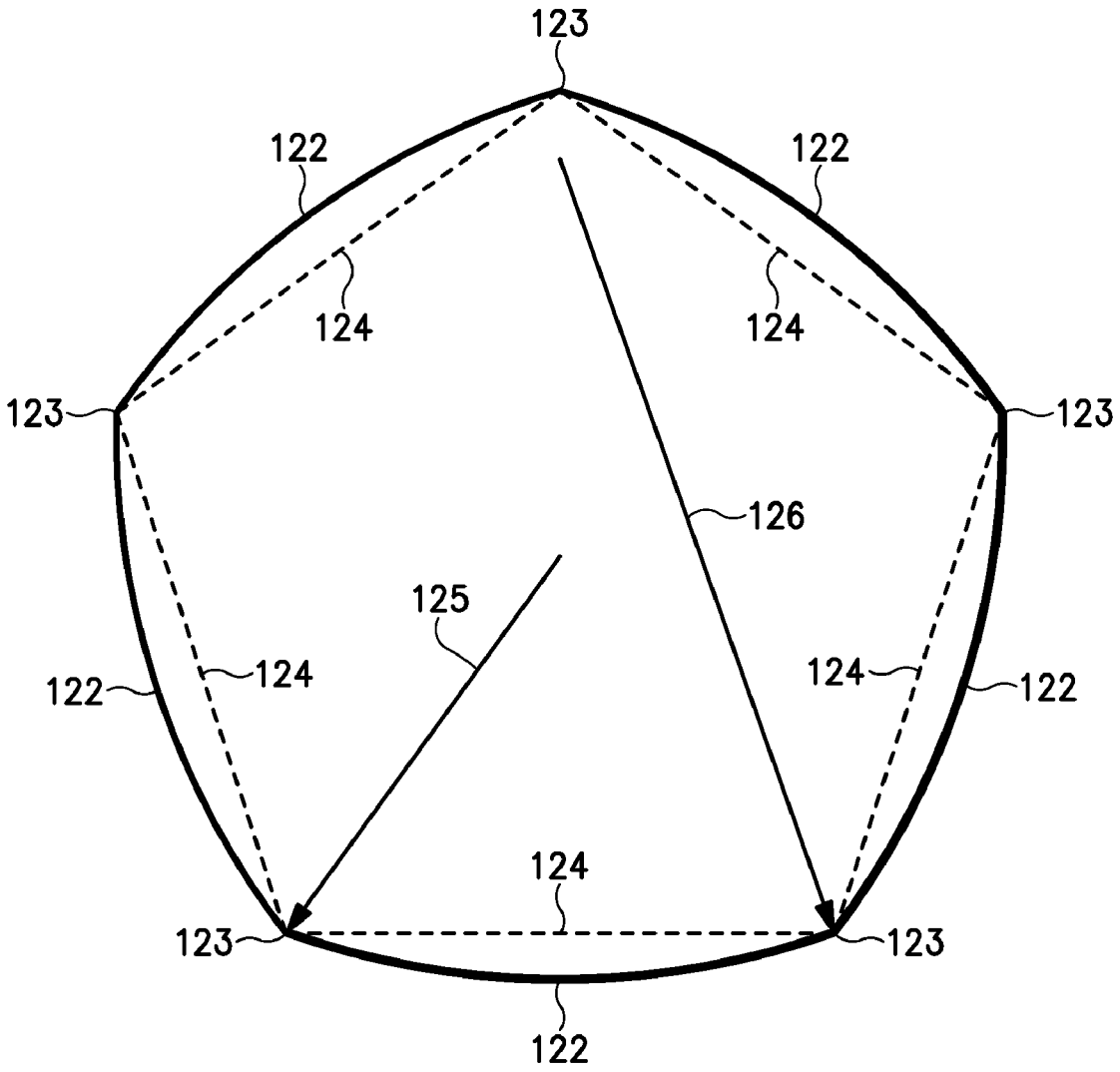
FIGS. 5A-5C depict various configurations for the pentagonal panel
Figure 5B:
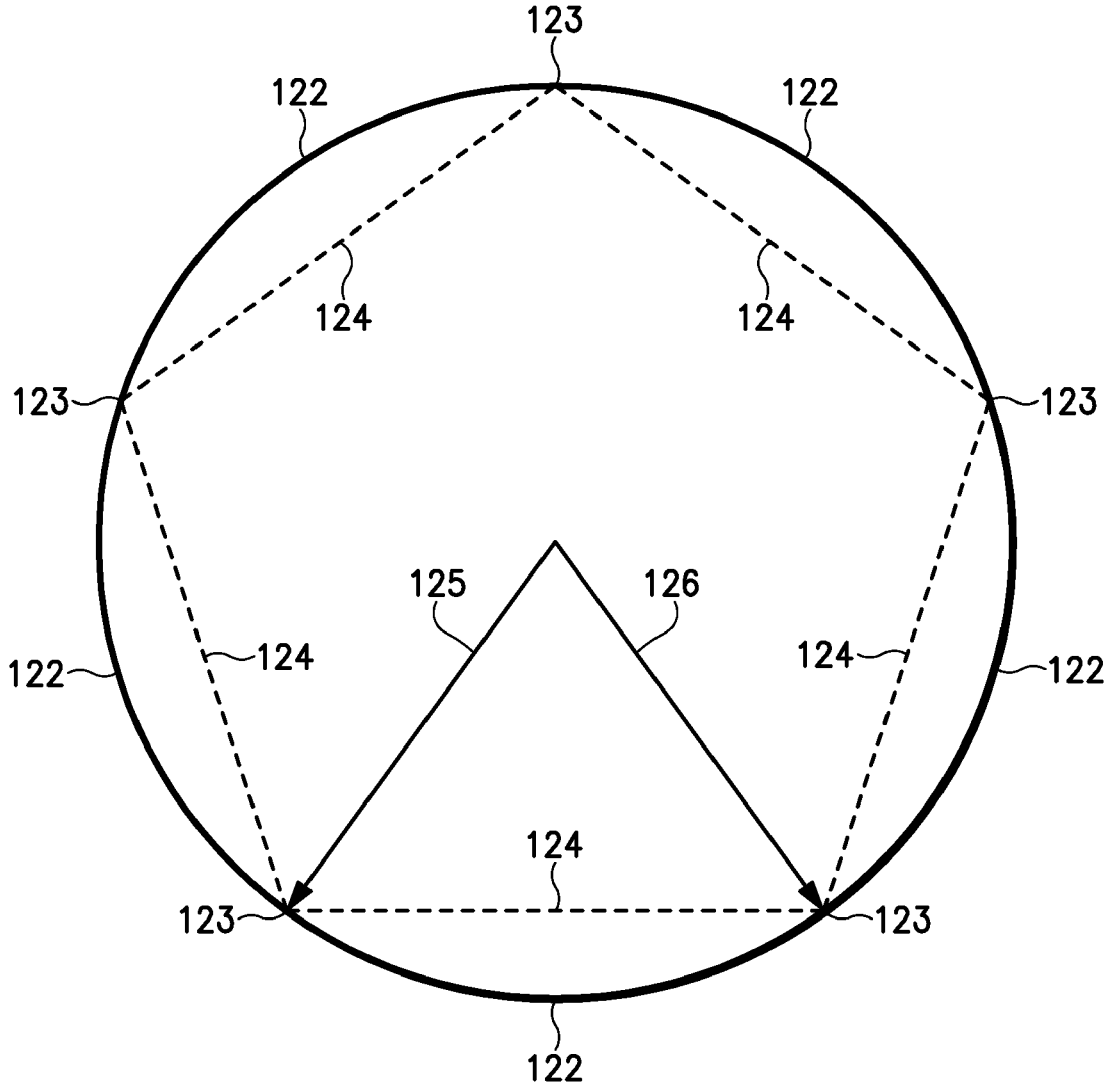
Figure 5C:
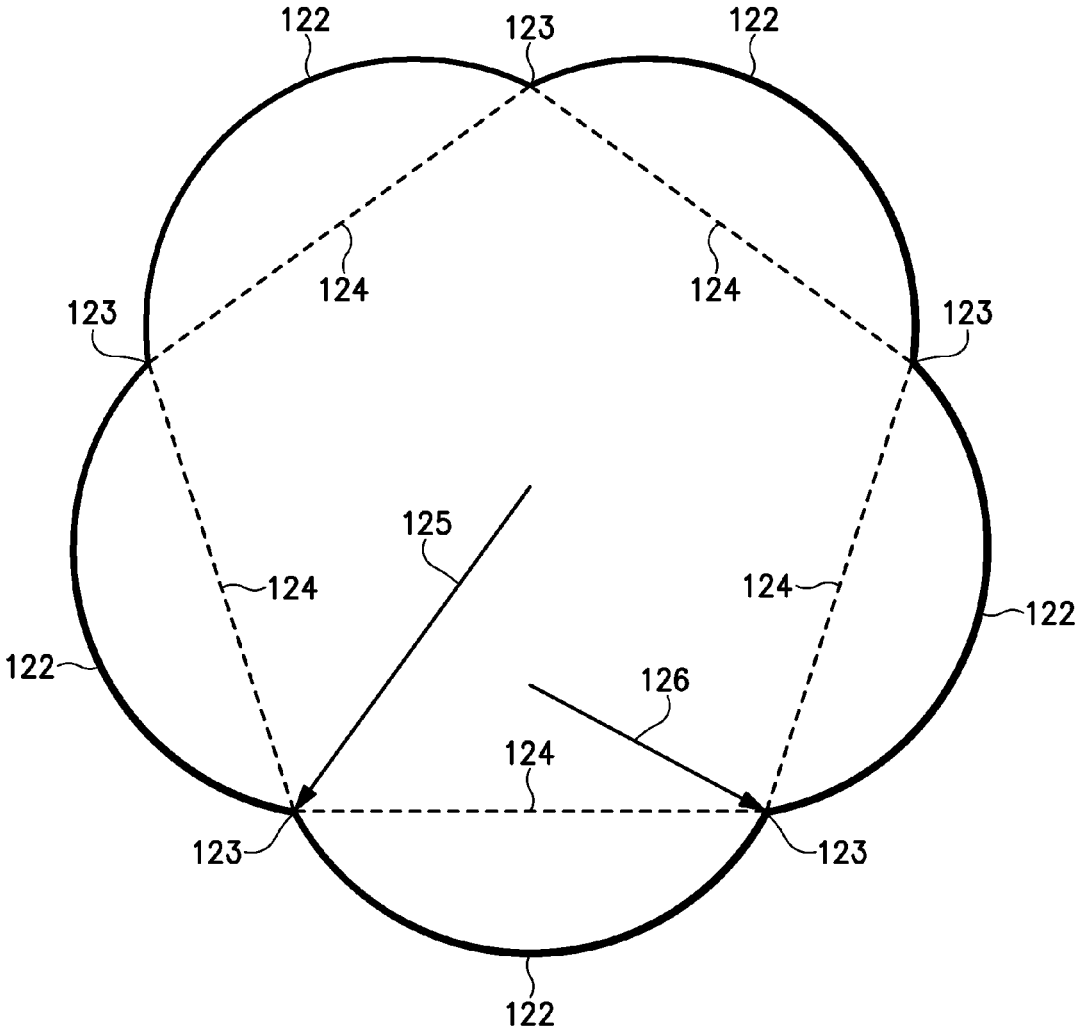

As discussed above, the relative lengths of edges 112 and chords 114 may vary significantly, and this relative length has an effect upon the concavity of 112 and the convexity of edges 122. With reference to FIG. 5A, pentagonal panel 120 is depicted as including a line 125 that extends from a center of pentagonal panel 120 to one of vertices 123. In addition, a line 126 is depicted that represents a radius associated with one of edges 122. In this example, a length of line 126 is greater than a length of line 125. With reference to FIG. 5B, another configuration of pentagonal panel 120 is depicted as including line 125 and line 126. In this example, the length of line 126 is equal to the length of line 125, and pentagonal panel 120 takes on a substantially spherical shape. With reference to FIG. 5C, pentagonal panel 120 is depicted as including line 125 and line 126. In this example, a length of line 126 is less than a length of line 125. Accordingly, the radius of curvature associated with edges 122 may be modified within the scope of the present invention to impart different shapes to pentagonal panels 120, including the shape discussed at length above, a substantially circular shape, or a shape wherein edges 122 bow outward significantly.

Figure 6:
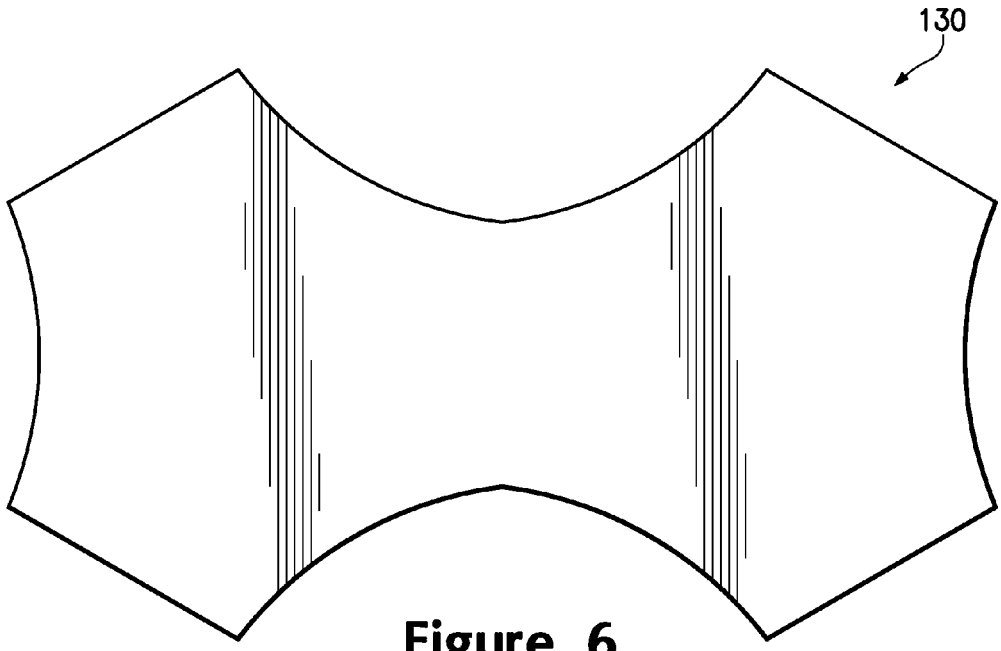
FIG. 6 is a plan view of a bridged panel.
Figure 7:
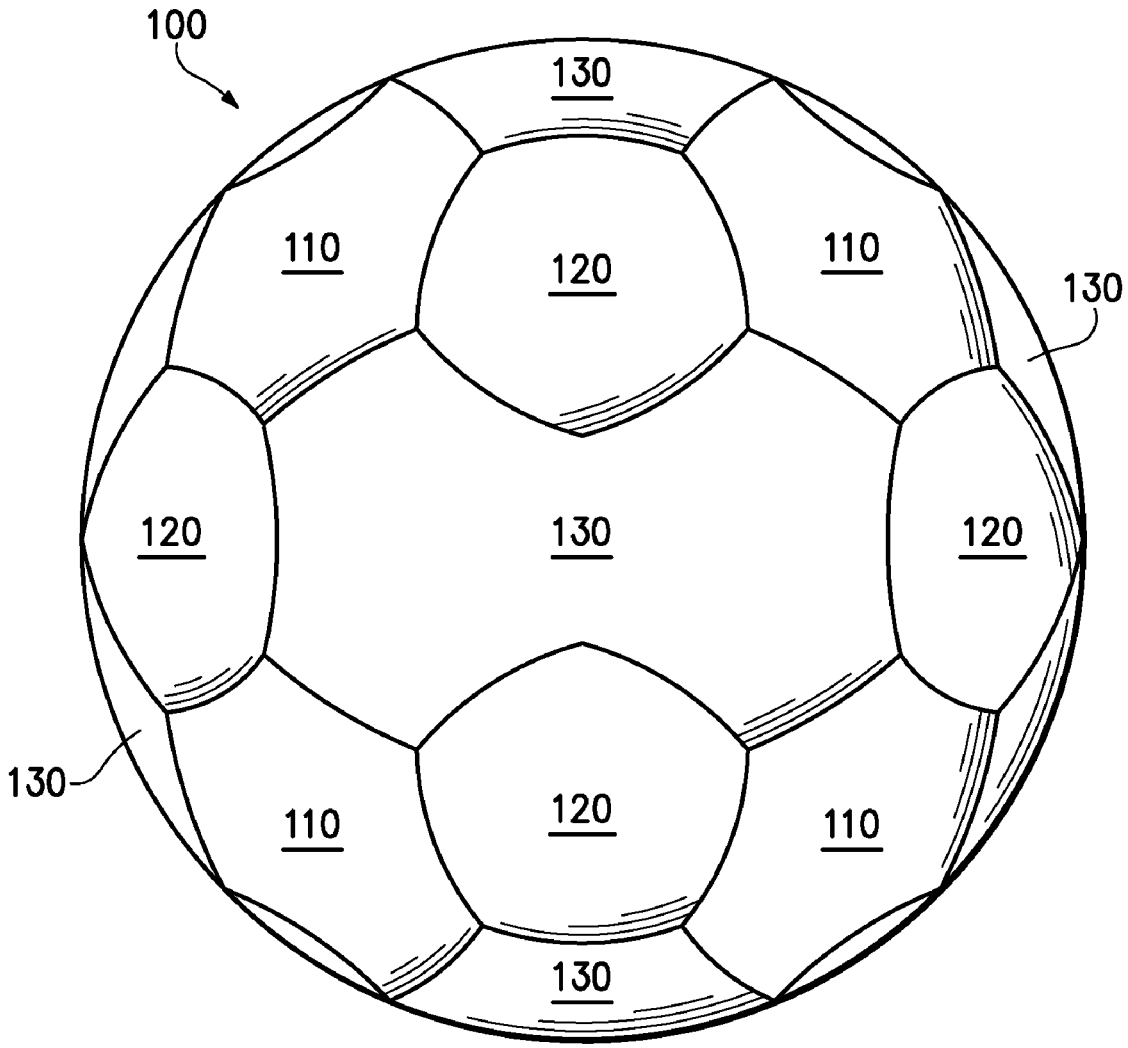
FIG. 7 is an elevational view of a game ball that incorporates the bridged panel.

With reference to FIG. 6, a bridged panel 130 is depicted as having the configuration of two seamlessly-joined hexagonal panels 110, thereby forming a decagonal (i.e., ten-sided) panel. As discussed above, ball 100 includes twenty hexagonal panels 110 and twelve pentagonal panels 120. Each of edges 111 of hexagonal panels 110 abut and are joined with other edges 111 from other hexagonal panels 110. Bridged panel 130, which is formed of unitary (i.e., one piece) construction, eliminates the seam between two adjacent hexagonal panels 110. As depicted in FIG. 7, six bridged panels 130 may be incorporated into ball 100 so as to replace two adjacent hexagonal panels 110. Given the orientation of ball 100 in FIG. 7, bridged panels 130 are located in a front portion, a rear portion (not depicted) that is opposite and behind the front portion, two side portions, and upper and lower portions of ball 100. Accordingly, ball 100 may incorporate six bridged panels 130. In some configurations, ball 100 may only incorporate between one and ten bridged panels 130.

Figure 8:
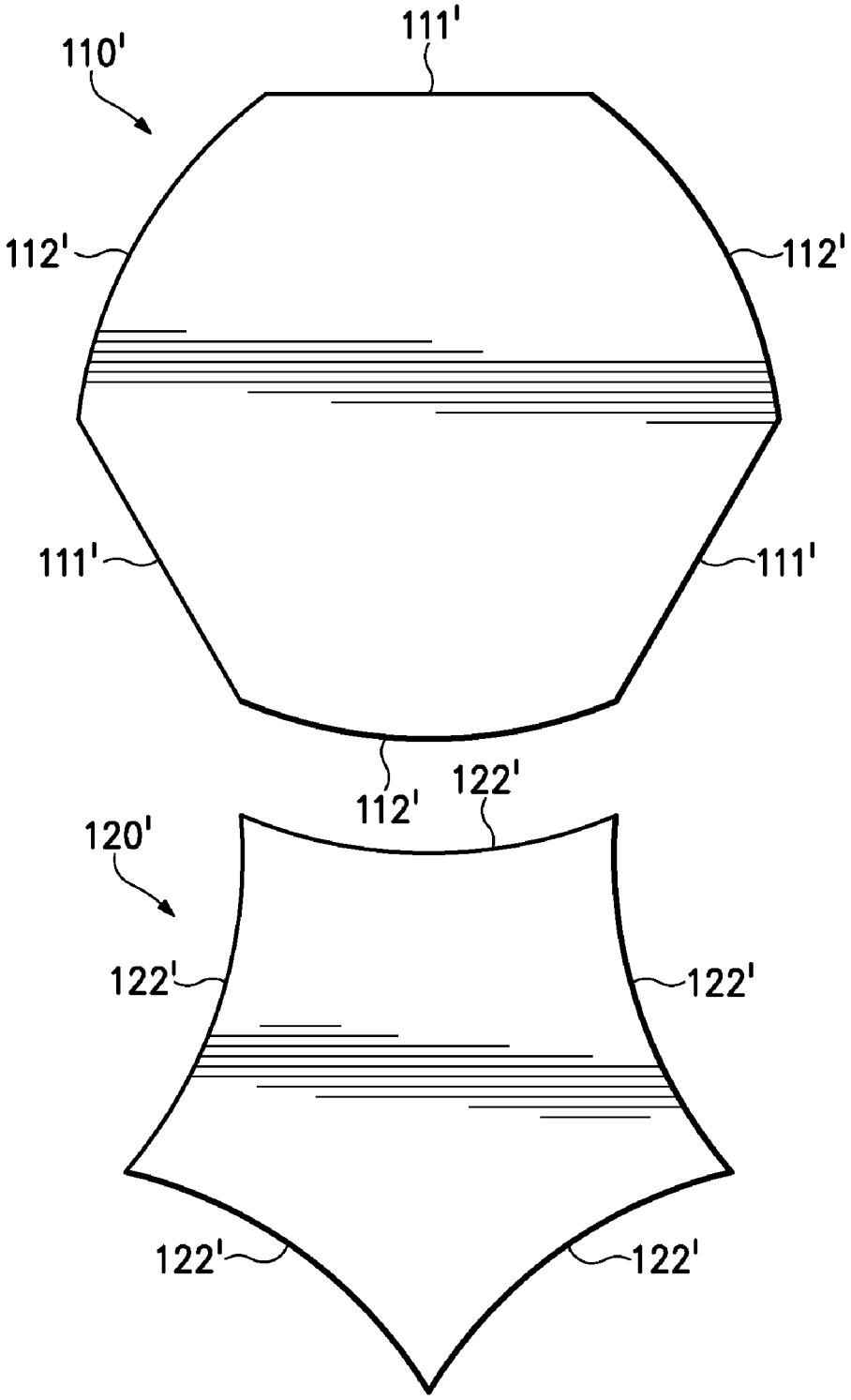
FIG. 8 is a plan view of another configuration of a hexagonal panel and a pentagonal panel.

Another panel configuration is depicted in FIG. 8 and includes a hexagonal panel 110' and a pentagonal panel 120'. Hexagonal panel 110' has three edges 111' that alternate with three edges 112'. Whereas each of edges 111' has a substantially straight configuration, each of edges 112' are curved outward to impart a convex configuration. Pentagonal panel 120' has five edges 122' that curve inward to impart a concave configuration. When incorporated into a ball, twenty hexagonal panels 110' and twelve pentagonal panels 120' may be used in a manner that is similar to ball 100. Furthermore, two of hexagonal panels 110' may be bridged (i.e., joined to exhibit a seamless configuration) in a manner that is similar to bridged panel 130.

The above discussion discloses various configurations of a game ball with a panel configuration that includes various hexagonal panels and pentagonal panels. In contrast with the straight-sided panels of a traditional soccer ball, the game balls disclosed above have curved or otherwise concave and convex sides that equalize stresses in the panels. Advantages of the equalized stresses include greater sphericity, more equal deflection, more equal stresses in seams between panels, and more even wear.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. A substantially spherical game ball comprising:

a plurality of substantially pentagonal panels, each of the substantially pentagonal panels having first edges, at least one of the first edges having a non-linear configuration;

a plurality of substantially hexagonal panels, each of the substantially hexagonal panels having second edges, at least one of the second edges having a non-linear configuration, the substantially pentagonal panels and the substantially hexagonal panels being connected along abutting first edges and second edges, and the substantially hexagonal panels being connected to each other along abutting second edges; and a substantially decagonal panel having a shape of two of the substantially hexagonal panels wherein a similarity in size between an area of each of the plurality of substantially hexagonal panels and an area of each of the plurality of substantially pentagonal panels is greater than in a configuration where each of the plurality of substantially hexagonal panels and the plurality of substantially pentagonal panels includes all linear edges.

2. The game ball recited in claim 1, wherein the first edges having the non-linear configuration are convex, and the second edges having the non-linear configuration are concave.

3. The game ball recited in claim 2, wherein the abutting second edges are substantially linear.

4. The game ball recited in claim 1, wherein the first edges having the non-linear configuration are concave, and the second edges having the non-linear configuration are convex.

5. The game ball recited in claim 4, wherein the abutting second edges are substantially linear.

6. The game ball recited in claim 1, wherein three of the second edges of each of the substantially hexagonal panels have the non-linear configuration, and three of the second edges of each of the substantially hexagonal panels are substantially linear.

7. The game ball recited in claim 6, wherein a length of a chord of each of the second edges with the non-linear configuration is greater than a length of the second edges that are substantially linear.

8. The game ball recited in claim 6, wherein a length of a chord of each of the second edges with the non-linear configuration is in a range of 1.10 and 1.30 times a length of the second edges that are substantially linear.

9. The game ball recited in claim 6, wherein a length of a chord of each of the second edges with the non-linear configuration is approximately 1.19 times a length of the second edges that are substantially linear.

10. A substantially spherical game ball comprising:

a plurality of substantially pentagonal panels, each of the substantially pentagonal panels having five convex edges;

a plurality of substantially hexagonal panels, each of the substantially hexagonal panels having three substantially linear edges and three concave edges, the substantially pentagonal panels and the substantially hexagonal panels being connected to each other along abutting concave edges and convex edges, and the substantially hexagonal panels being connected each other along abutting linear edges; and a bridged panel having a shape of two of the substantially hexagonal panels joined along the linear edges in a seamless configuration, wherein a similarity in size between an area of each of the plurality of substantially hexagonal panels and an area of each of the plurality of substantially pentagonal panels is greater than in a configuration where each of the plurality of substantially hexagonal panels and the plurality of substantially pentagonal panels includes all linear edges.

11. The game ball recited in claim 10, wherein a length of a chord of each of the concave edges is greater than a length of the linear edges.

12. The game ball recited in claim 10, wherein a length of a chord of each of the concave edges is in a range of 1.10 and 1.30 times a length of the linear edges.

13. The game ball recited in claim 10, wherein a length of a chord of each of the concave edges is approximately 1.19 times a length of the linear edges.

14. A substantially spherical game ball including a plurality of panels connected along abutting edges, the plurality of panels comprising:

six bridge panels that include two substantially hexagonal portions, each of the substantially hexagonal portions having three concave edges and three substantially linear edges, the substantially hexagonal portions being seamlessly joined along two of the one first edge of the first substantially hexagonal portion and one first edge of the second substantially hexagonal portion;

eight substantially hexagonal panels having three concave edges and three substantially linear edges; and twelve substantially pentagonal panels having five convex edges, wherein a similarity in size between an area of each of the plurality of substantially hexagonal panels and an area of each of the plurality of substantially pentagonal panels is greater than in a configuration where each of the plurality of substantially hexagonal panels and the plurality of substantially pentagonal panels includes all linear edges.

15. The game ball recited in claim 14, wherein a length of a chord of each of the concave edges of the substantially hexagonal panels is greater than a length of the linear edges of the substantially hexagonal panels.

16. The game ball recited in claim 14, wherein a length of a chord of each of the concave edges of the substantially hexagonal panels is in a range of 1.10 and 1.30 times a length of the linear edges of the substantially hexagonal panels.

17. The game ball recited in claim 14, wherein a length of a chord of each of the concave edges of the substantially hexagonal panels is approximately 1.19 times a length of the linear edges of the substantially hexagonal panels.

* * * * *